US011655689B2

(12) United States Patent
Merron et al.

(10) Patent No.: US 11,655,689 B2
(45) **Date of Patent: *May 23, 2023**

(54) WIRELESS ACTIVATION OF WELLBORE COMPLETION ASSEMBLIES

(71) Applicant: Halliburton Energy Services, Inc., Houston, TX (US)

(72) Inventors: Matthew James Merron, Dallas, TX (US); Zachary William Walton, Carrollton, TX (US); Michael Linley Fripp, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 74 days.

This patent is subject to a terminal disclaimer.

(21) Appl. No.: 17/307,966

(22) Filed: May 4, 2021

(65) Prior Publication Data

US 2021/0254433 A1 Aug. 19, 2021

Related U.S. Application Data

(63) Continuation of application No. 16/335,242, filed as application No. PCT/US2016/059641 on Oct. 31, 2016, now Pat. No. 11,035,203.

(51) Int. Cl.
*E21B 34/16* (2006.01)
*E21B 43/14* (2006.01)
(Continued)

(52) U.S. Cl.
CPC ..... *E21B 34/16* (2013.01); *E21B 34/066* (2013.01); *E21B 34/14* (2013.01); *E21B 43/00* (2013.01);
(Continued)

(58) Field of Classification Search
CPC ..... E21B 34/063; E21B 34/066; E21B 34/14; E21B 34/16; E21B 43/26; E21B 47/12; E21B 2200/06
See application file for complete search history.

(56) References Cited

U.S. PATENT DOCUMENTS 3,517,758 A 6/1970 Schuster
4,745,975 A 5/1988 Price
(Continued)

FOREIGN PATENT DOCUMENTS

CA 2168311 A1 7/1996
WO 2014124533 A1 8/2014
WO 2014046841 A3 4/2015

OTHER PUBLICATIONS

Schlumberger Oilfield Glossary—Sliding Sleeve via Way Back Machine, https://web.archive.org/web/20180807115838/http://www.glossary.oilfield.slb.com/Terms/s/sliding_sleeve.aspx (Year: 2018).
(Continued)

*Primary Examiner* — David Carroll
(74) *Attorney, Agent, or Firm* — Barnes & Thornburg, LLP

(57) ABSTRACT

A completion section includes a base pipe defining a central flow passage, an injection port, and a production port. A fracturing assembly includes a frac sleeve positioned within the central flow passage adjacent the injection port, a sensor that detects a wireless signal, a first frac actuator actuatable in response to the wireless signal to move the frac sleeve and expose the injection port, and a second frac actuator actuatable based on the wireless signal to move the frac sleeve to occlude the injection port. A production assembly is axially offset from the fracturing assembly and includes a production sleeve positioned within the central flow passage adjacent the production port, a filtration device arranged about the base pipe, and a production actuator actuatable
(Continued)

based on the wireless signal or an additional wireless signal to move the production sleeve to an open position where the production ports are exposed.

24 Claims, 10 Drawing Sheets

(51) Int. Cl.

| | |
|---|---|
| ***E21B 43/26*** | (2006.01) |
| ***E21B 47/12*** | (2012.01) |
| ***E21B 34/06*** | (2006.01) |
| ***E21B 43/17*** | (2006.01) |
| ***E21B 43/25*** | (2006.01) |
| ***E21B 43/00*** | (2006.01) |
| ***E21B 34/14*** | (2006.01) |
| ***E21B 43/08*** | (2006.01) |
| ***E21B 47/10*** | (2012.01) |
| *E21B 47/07* | (2012.01) |
| *E21B 34/10* | (2006.01) |
| *E21B 47/06* | (2012.01) |

(52) U.S. Cl.
CPC ..... *E21B 43/088* (2013.01); *E21B 43/14* (2013.01); *E21B 43/17* (2013.01); *E21B 43/25* (2013.01); *E21B 43/26* (2013.01); *E21B 47/10* (2013.01); *E21B 47/12* (2013.01); *E21B 34/063* (2013.01); *E21B 34/10* (2013.01); *E21B 47/06* (2013.01); *E21B 47/07* (2020.05); *E21B 2200/06* (2020.05)

(56) References Cited

U.S. PATENT DOCUMENTS

| | | | | |
|---|---|---|---|---|
| 8,616,276 | B2 | 12/2013 | Tips et al. | |
| 8,646,537 | B2 | 2/2014 | Tips et al. | |
| 8,757,274 | B2 | 6/2014 | Skinner et al. | |
| 11,035,203 | B2 * | 6/2021 | Merron | E21B 43/00 |
| 2010/0000727 | A1 | 1/2010 | Webb et al. | |
| 2012/0061095 | A1 | 3/2012 | Capderou | |
| 2013/0048290 | A1 | 2/2013 | Howell et al. | |
| 2014/0083689 | A1 | 3/2014 | Streich et al. | |
| 2014/0102708 | A1 | 4/2014 | Purkis et al. | |
| 2014/0262240 | A1 | 9/2014 | Boone et al. | |
| 2014/0299330 | A1 | 10/2014 | Fripp et al. | |
| 2015/0369023 | A1 | 12/2015 | MacPhail et al. | |
| 2017/0058646 | A1 | 3/2017 | Bernardi et al. | |

OTHER PUBLICATIONS

International Search Report & Written Opinion issued in PCT Appln. No. PCT/US2016/059641, dated Jul. 27, 2017.
Search Report and Opinion in DK Appln No. PA 2019 00273, dated Dec. 20, 2019.

* cited by examiner

WIRELESS ACTIVATION OF WELLBORE COMPLETION ASSEMBLIES

CROSS-REFERENCE TO RELATED APPLICATIONS

This Continuation application claims priority to and benefit of U.S. application Ser. No. 16/335,242, filed Mar. 20, 2019, and International application no. PCT/US2016/059641, filed Oct. 31, 2016, the disclosures of which are incorporated by reference herein in its entirety.

BACKGROUND

Hydrocarbon-producing wells are often stimulated by hydraulic fracturing operations in order to enhance the production of hydrocarbons present in subterranean formations. During a typical fracturing operation, a servicing fluid (i.e., a fracturing fluid or a perforating fluid) is introduced into a wellbore that penetrates a subterranean formation and is injected into the subterranean formation at a hydraulic pressure sufficient to create or enhance a network of fractures therein. The resulting fractures serve to increase the conductivity potential for extracting hydrocarbons from the subterranean formation.

In some wellbores, it may be desirable to selectively generate multiple fracture networks along the wellbore at predetermined distances apart from each other, thereby creating multiple interval "pay zones" in the subterranean formation. Each pay zone may include a corresponding fracturing assembly used to initiate and carry out the hydraulic fracturing operation. Following the hydraulic fracturing operation, the fracturing assemblies are closed and corresponding production assemblies are initiated and operated to extract hydrocarbons from the various pay zones. Extracted hydrocarbons are then conveyed to the well surface for collection.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole completion assemblies in the oil and gas industry and, more particularly, to actuating fracturing and production assemblies using wireless communication to undertake hydraulic fracturing and production operations.

Embodiments disclosed herein describe the actuation (movement between open and closed positions) of fracture and production sleeves used in associated fracturing and production assemblies, respectively, through wireless means. One example, completion section for a downhole completion assembly includes a base pipe that defines a central flow passage, one or more injection ports, and one or more production ports. A fracturing assembly is included in the completion section and includes a frac sleeve positioned within the central flow passage adjacent the injection ports, a sensor that detects a wireless signal, a first frac actuator actuatable in response to the wireless signal to move the frac sleeve and expose the injection ports, and a second frac actuator actuatable based on the wireless signal to move the frac sleeve to occlude the injection ports. A production assembly is also included in the completion section and is axially offset from the fracturing assembly. The fracturing assembly includes a production sleeve positioned within the central flow passage adjacent the production ports, a filtration device arranged about the base pipe, and a production actuator actuatable based on the wireless signal or an additional wireless signal to move the production sleeve to an open position where the production ports are exposed.

Figure 1:
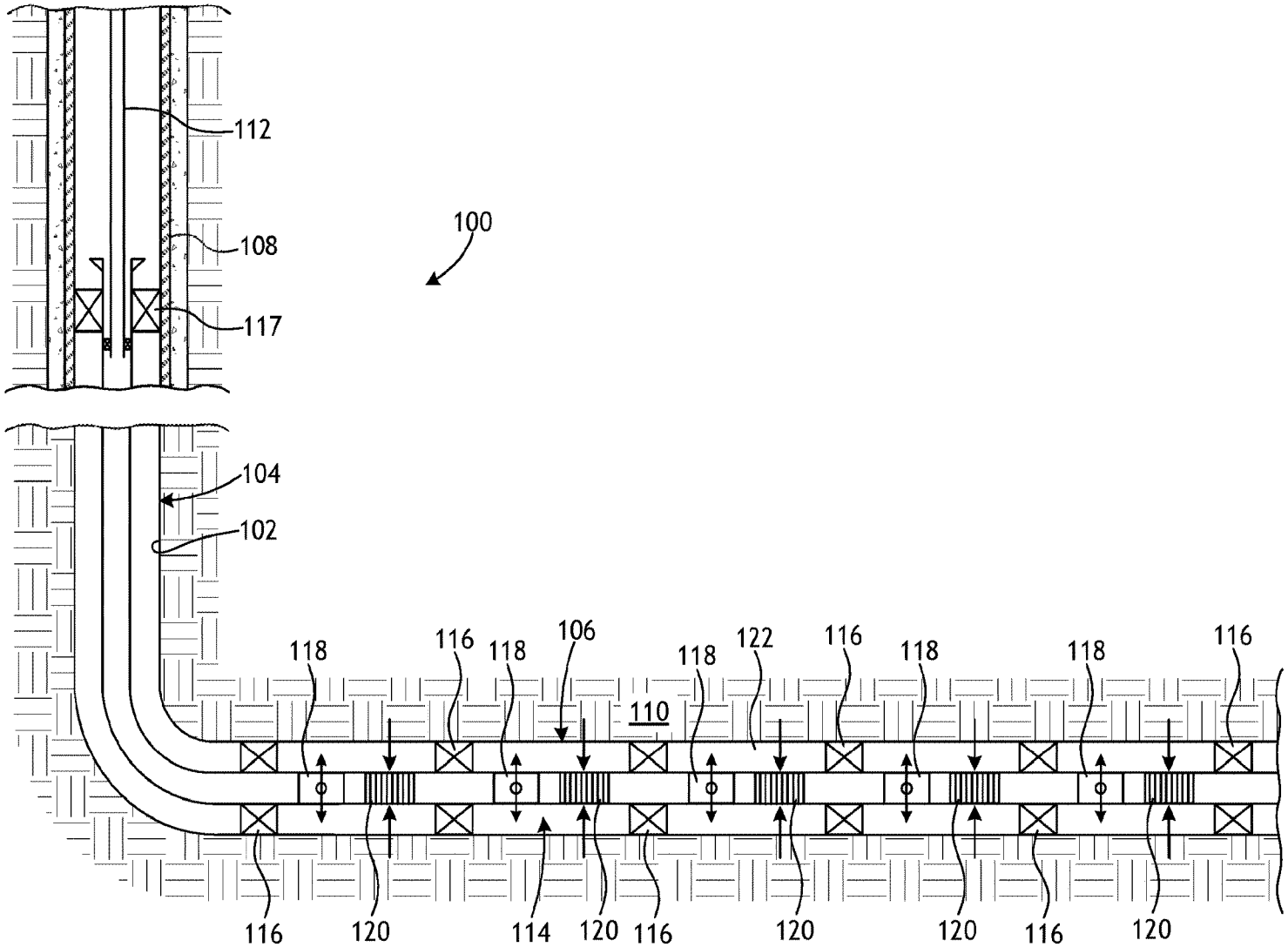
FIG. 1 is a well system that may employ the principles of the present disclosure.

FIG. 1 is a well system 100 that may employ the principles of the present disclosure, according to one or more embodiments of the disclosure. As depicted, the well system 100 includes a wellbore 102 that extends through various earth strata and has a substantially vertical section 104 that transitions into a substantially horizontal section 106. The upper portion of the vertical section 104 may be lined with a string of casing 108 cemented therein to support the wellbore 102, and the horizontal section 106 may extend through one or more hydrocarbon bearing subterranean formations 110. In at least one embodiment, as illustrated, the horizontal section 106 may comprise an open hole section of the wellbore 102. In other embodiments, however, the casing 108 may also extend into the horizontal section 106, without departing from the scope of the disclosure.

A work string 112 is extended into the wellbore 102 from a surface location, such as the Earth's surface, and may be used to convey ("run") a wellbore completion assembly 114 into the wellbore 102. As illustrated, the completion assembly 114 may be coupled to the end of the work string 112 and generally arranged within the horizontal section 106. In at least one embodiment, the completion assembly 114 divides the wellbore 102 into various production intervals or "pay zones" adjacent the subterranean formation 110. To accomplish this, as illustrated, the completion assembly 114 includes a plurality of wellbore packers 116 axially spaced from each other along the length of the completion assembly 114. Once set within the wellbore 102, each wellbore packer 116 provides a corresponding fluid seal between the completion assembly 114 and the inner wall of the wellbore 102, and thereby effectively defines discrete production intervals within the wellbore 102. Sections of the completion assembly 114 between axially adjacent wellbore packers 116 may be referred to herein as "completion sections," alternately referred to as production intervals.

It should be noted that even though FIG. 1 depicts multiple completion sections defined by the separating wellbore packers 116, the completion assembly 114 may provide any number of completion sections with a corresponding number of wellbore packers 116 arranged therein. In other embodiments, for example, the wellbore packers 116 may be entirely omitted from the completion assembly 114, and the system 100 may alternatively include only a single upper wellbore packer 117 that isolates the entire completion assembly 114 from upper portions of the wellbore 102.

In the illustrated embodiment, each completion section may include at least one fracturing assembly 118 and at least one production assembly 120. In other embodiments, however, such as in embodiments where the multiple wellbore packers 116 are replaced with the upper wellbore packer 117, the system 100 may alternatively include only one fracturing assembly 118 and one or more production assemblies 120 used to service the entire completion assembly 114. The fracturing assembly(ies) 118 may be actuated or otherwise operated to inject a fluid into the annulus 122 defined between the completion assembly 114 and the wellbore 102. The fluid injected by the fracturing assemblies 118 may comprise, for example, a fracturing fluid used to create a network of fractures in the surrounding formation 110. The fluid may also or alternatively comprise a gravel slurry that fills the annulus 122 following the creation of the fracture network. In yet other applications, the fluid injected by the fracturing assemblies 118 may comprise a stimulation fluid, a treatment fluid, an acidizing fluid, a conformance fluid, or any combination of the foregoing fluids.

Upon closing the fracturing assembly(ies) 118, a corresponding production assembly 120 may subsequently be actuated or otherwise operated to draw in fluids from the formation 110 to be conveyed to the surface of the well for collection. Each production assembly 120 serves the primary function of filtering particulate matter out of the production fluid stream originating from the formation 110 such that particulates and other fines are not produced to the surface. To accomplish this, the production assemblies 120 may include one or more filtration devices, such as well screens or slotted liners that allow fluids to flow therethrough but generally prevent the influx of particulate matter of a predetermined size.

While FIG. 1 depicts the completion assembly 114 as being arranged in a generally horizontal section 106 of the wellbore 102, the completion assembly 114 is equally well suited for use in other directional configurations including vertical, deviated, slanted, or any combination thereof. The use of directional terms herein such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Actuation or operation of the fracturing assemblies 118 and the production assemblies 120 is conventionally undertaken by introducing a shifting tool downhole and physically engaging and moving corresponding fracture and production sleeves between open and closed positions. According to embodiments of the present disclosure, however, actuating the corresponding fracture and production sleeves between open and closed positions may be accomplished through wireless means. In some embodiments, for instance, predetermined wireless signals may be conveyed and otherwise transmitted to one or both of the fracturing and production assemblies 118, 120. Upon detection of the predetermined wireless signals, actuation of the fracturing and production assemblies 118, 120 may be triggered for operation. In other embodiments, however, one wireless signal may be provided and detected to operate a given fracturing assembly 118, and a corresponding production assembly 120 may be subsequently actuated based on a timer triggered by the wireless signal. The following discussion provides several examples as to how the fracturing and production assemblies 118, 120 may be wirelessly operated.

FIGS. 2A-2E are cross-sectional side views of an example fracturing assembly 200, according to one or more embodiments. The fracturing assembly 200 may be the same as or similar to the any of the fracturing assemblies 118 of FIG. 1 and, therefore, may be included in the completion assembly 114 (FIG. 1) and used to inject a fluid into the annulus 122 defined between the completion assembly 114 and the wellbore 102 (FIG. 1). FIGS. 2A-2E depict progressive views of the fracturing assembly 200 during example operation.

Figure 2A:
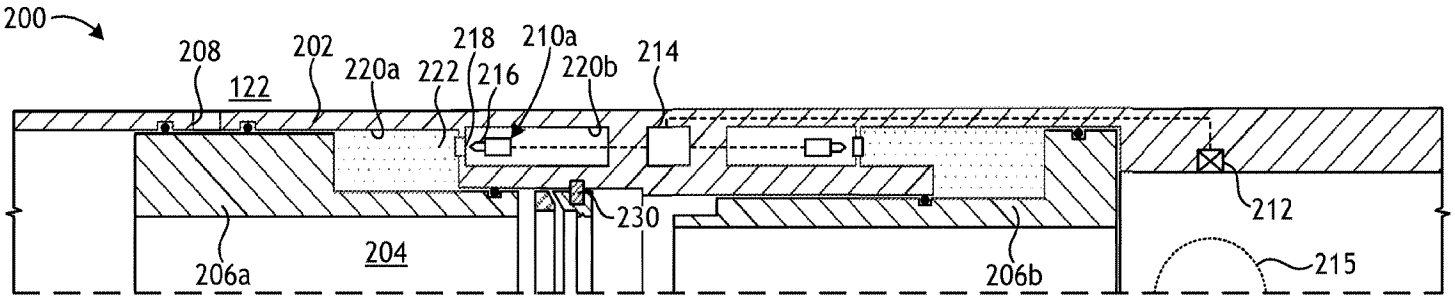
FIGS. 2A-2E are cross-sectional side views of an example fracturing assembly.

In FIG. 2A, the fracturing assembly 200 is depicted as including a base pipe 202 that defines a central flow passage 204. The base pipe 202 may form an integral part of the completion assembly 114 (FIG. 1), such as being coupled between opposing lengths of the completion assembly 114. As a result, the central flow passage 204 may be in fluid communication with the work string 112 (FIG. 1) such that fluids and objects (e.g., wellbore projectiles) conveyed into the wellbore 102 (FIG. 1) via the work string 112 will communicate with (flow into) the central flow passage 204.

The fracturing assembly 200 may further include a fracture sleeve 206*a* (alternately referred to as a "frac" sleeve) and a closure sleeve 206*b*, each being positioned for longitudinal movement within the central flow passage 204. One or more injection ports 208 (one shown) are defined in the wall of the base pipe 202 and are blocked (occluded) when the frac sleeve 206*a* is in a first or "closed" position, thereby preventing fluid communication between the annulus 122 and the central flow passage 204. As described below, however, the frac sleeve 206*a* is actuatable to move (i.e., displace) to a second or "open" position where the injection ports 208 are exposed.

To move the frac sleeve 206*a* to the open position, a first frac actuator 210*a* is triggered based on a wireless signal received or otherwise detected by a sensor 212. While the sensor 212 is shown located downhole from the frac sleeve 206*a*, the sensor 212 could alternatively be located uphole from the frac sleeve 206*a*, without departing from the scope of the disclosure. The sensor 212 may comprise a variety of types of downhole sensors configured to detect or otherwise receive a variety of wireless signals. Moreover, the wireless signal may originate from a variety of locations, devices, or otherwise provided via a variety of means. In some applications, for example, the wireless signal may be transmitted from a well surface location or from an adjacent wellbore. In other applications, the wireless signal may be transmitted via a device or means located in or conveyed through the wellbore 102 (FIG. 1). In such embodiments, the device or means may comprise an untethered tool, but could alternately be attached to a conveyance, such as wireline or slickline.

In some embodiments, the sensor 212 may comprise a magnetic sensor configured to detect the presence of a magnetic field or property produced by a wellbore projectile conveyed through the central flow passage 204. In such embodiments, the sensor 212 may comprise, but is not limited to, a magneto-resistive sensor, a Hall-effect sensor, a conductive coil, or any combination thereof. In some embodiments, one or more permanent magnets can be combined with the sensor 212 to create a magnetic field that is disturbed by a wellbore projectile (or the like), and a detected change in said magnetic field can be an indication of the presence of the wellbore projectile.

In other embodiments, however, the sensor 212 may be configured to detect other types of wireless signals such as, but not limited to, an electromagnetic signal, a pressure signal, a temperature signal, an acoustic signal (e.g., noise), a fluid flowrate signal, or any combination thereof. Consequently, the sensor 212 may alternatively comprise at least one of an antenna, a pressure sensor, a temperature sensor, an acoustic sensor, a vibration sensor, a strain sensor, an accelerometer, a flow meter, or any combination thereof.

The sensor 212 is communicably connected to an electronics module 214 that includes electronic circuitry configured to determine whether the sensor 212 has detected a particular or predetermined wireless signal. The electronics module 214 may include a power supply, such as one or more batteries, a fuel cell, a downhole generator, or any other source of electrical power used to power operation of one or more of the electronics module 214, the sensor 212, and the first frac actuator 210*a*.

In embodiments where the sensor 212 is a magnetic sensor, the electronic circuitry may be configured to determine whether the sensor 212 has detected a predetermined magnetic field, a pattern or combination of magnetic fields, or another magnetic property of a magnetic projectile 215 (shown in dashed) introduced into the central flow passage 204. The magnetic projectile 215 may be pumped to or past the sensor 212 in order to transmit a magnetic signal to the first frac actuator 210*a*. The electronics module 214 may include a non-volatile memory having a database programmed with a predetermined magnetic field(s) or other magnetic properties for comparison against magnetic fields/properties exhibited by the magnetic projectile 215 and detected by the sensor 212.

In the illustrated embodiment, the magnetic projectile 215 is depicted in the form of a sphere or ball, such as a frac ball known to those skilled in the art, but could alternatively comprise other shapes or types of wellbore projectiles, such as a dart or a plug. In other embodiments, the magnetic projectile 215 may comprise a fluid or a gel, such as a ferrofluid, a magnetorheological fluid, or another type of fluid that exhibits magnetic properties detectable by the sensor 212. In yet other embodiments, the magnetic projectile 215 might comprise a pill or slurry of magnetic particles pumped into the central flow passage 204 to be detected by the sensor 212. In even further embodiments, the magnetic projectile 215 may comprise a downhole tool, such as a perforating charge with a magnetic attachment added to the perforating charge.

In embodiments where the sensor 212 is a pressure sensor, predetermined pressure levels or sequences may be programmed into the memory of the electronics module 214 for comparison against an actual fluid pressure or a series (pattern) of pressure changes (fluctuations) detected in the central flow passage 204 by the sensor 212. Accordingly, to actuate the first frac actuator 210*a*, a well operator may selectively pressurize the central flow passage 204 to match one of the programmed pressure levels or sequences.

In embodiments where the sensor 212 is a temperature sensor, a predetermined temperature level or disparity (fluctuation) may be programmed into the memory of the electronics module 214 for comparison against the real-time temperature or temperature fluctuations detected in the central flow passage 204 by the sensor 212.

In embodiments where the sensor 212 is an acoustic sensor, predetermined acoustic signatures or acoustic sequences may be programmed into the memory of the electronics module 214 for comparison against noises or a series (pattern) of noise changes detected by the sensor 212. Such noises may be generated, for example, by axially translating and/or rotating a pipe string or other downhole tool within the wellbore. In other embodiments, however, the noises may comprise acoustic signals transmitted to the sensor 212 from a remote location, such as the well surface. In yet other embodiments, the noise may be generated by fluid movement.

If the electronics module 214 determines that the sensor 212 has affirmatively detected a predetermined or particular wireless signal, the electronic circuitry triggers actuation of the first frac actuator 210*a* to cause the frac sleeve 206*a* to move towards the open position to expose the injection ports 208.

In the illustrated example, the first frac actuator 210*a* includes a piercing member 216 operable to pierce a pressure barrier 218 that initially separates a first chamber 220*a* and a second chamber 220*b* each defined in the base pipe 202. The first frac actuator 210*a* can comprise any type of actuator (e.g., electrical, hydraulic, mechanical, explosive, chemical, a combination thereof, etc.) used to advance the piercing member 216 towards the pressure barrier 218 upon actuation. When the sensor 212 detects the predetermined wireless signal, the piercing member 216 pierces the pressure barrier 218, and a support fluid 222 (e.g., oil) flows from the first chamber 220*a* to the second chamber 220*b*, which generates a pressure differential across the frac sleeve 206*a*. The generated pressure differential urges the frac sleeve 206*a* to move (displace) toward the open position (i.e., to the right in FIG. 2A).

In some embodiments, the pressure differential generated by piercing the pressure barrier 218 may be sufficient to fully displace the frac sleeve 206*a* to its open position. In other embodiments, however, it may be required to pressurize the central flow passage 204 to move the frac sleeve 206*a* fully to its open position, as described below.

Figure 2B:
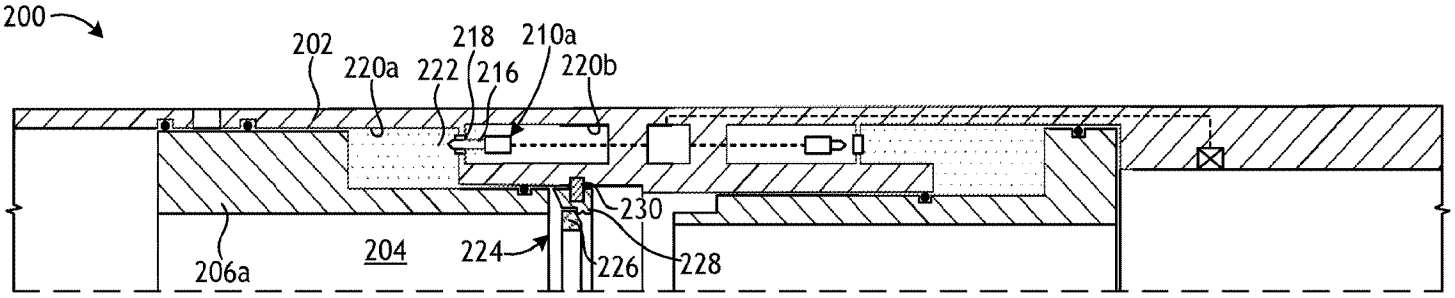

In FIG. 2B, the first frac actuator 210*a* is shown actuated as the piercing member 216 has pierced the pressure barrier 218 such that an amount of the support fluid 222 in the first chamber 220*a* is able to escape into the second chamber 220*b*. The support fluid 222 entering the second chamber 220*b* generates a pressure differential across the frac sleeve 206*a* that urges the frac sleeve 206*a* to displace downward (i.e., to the right in FIG. 2B) until engaging a baffle assembly 224 positioned in the central flow passage 204. As illustrated, the baffle assembly 224 includes a retractable baffle 226 and a baffle receiving sleeve 228 secured to the base pipe 202 with one or more shear members 230. As the frac sleeve 206*a* moves toward the open position it engages the retractable baffle 226 and forces the retractable baffle 226 against the baffle receiving sleeve 228. Opposing angled surfaces on the retractable baffle 226 and the baffle receiving sleeve 228 allow the retractable baffle 226 to slidingly engage and ride up onto the baffle receiving sleeve 228, and doing so radially contracts the retractable baffle 226 within the central flow passage 204 to a sealing position (i.e., a smaller inner diameter).

In this example, the retractable baffle 226 is in the form of an expandable ring that is contracted radially inward to its sealing position by the downward displacement of the frac sleeve 206*a*. In other examples, however, the retractable baffle 226 may comprise another type of radially contractible device or mechanism, without departing from the scope of the disclosure. Moreover, in this example further axial displacement of the frac sleeve 206*a* is prevented by the baffle receiving sleeve 228, which is secured to the base pipe 202 at the shear member 230.

Figure 2C:
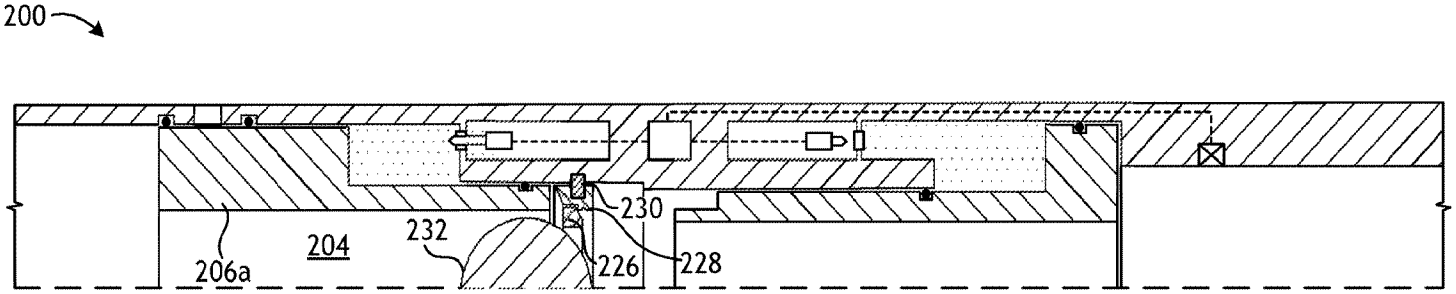

In FIG. 2C, with the retractable baffle 226 in the sealing position, the central flow passage 204 may be sealed and otherwise isolated with an isolation device 232 used to isolate the fracturing assembly 200 from downhole portions. In the illustrated embodiment, the isolation device 232 is in the form of a wellbore projectile that may be conveyed downhole to help fully move the frac sleeve 206*a* to the open position. More specifically, the isolation device 232 is conveyed to the fracturing assembly 200 and into the central flow passage 204 to be received by the retractable baffle 226. While depicted in FIG. 2C as a ball-type wellbore projectile, the isolation device 232 may alternatively comprise a dart, a wiper, a plug, or any other type of known wellbore projectile. The isolation device 232 may be conveyed to the fracturing assembly 200 by any known technique, such as by being dropped through the work string 112 (FIG. 1), pumped through the central flow passage 204, self-propelled, conveyed by wireline, slickline, coiled tubing, etc.

In embodiments where the differential pressure acting on the frac sleeve 206*a* is not sufficient to overcome the shear limit of the shear member 230, the isolation device 232 may be used to seal the central flow passage 204 such that hydraulic pressure may be applied against the isolation device 232 to free the baffle receiving sleeve 228. The isolation device 232 may be sized to locate and land on the retractable baffle 226 in its sealing position and thereby create a sealed interface. Once the isolation device 232 lands on the retractable baffle 226, the fluid pressure in the central flow passage 204 may be increased to surpass the shear limit of the shear member 230 and thereby free the baffle receiving sleeve 228. With the shear member 230 sheared, the remaining differential pressure across the frac sleeve 206*a* generated between the first and second chambers 220*a,b* may urge the frac sleeve 206*a* to displace the baffle receiving sleeve 228 and move to the open position. Otherwise, hydraulic pressure on the isolation device 232 may help urge the frac sleeve 206*a* to the fully open position.

Figure 2D:
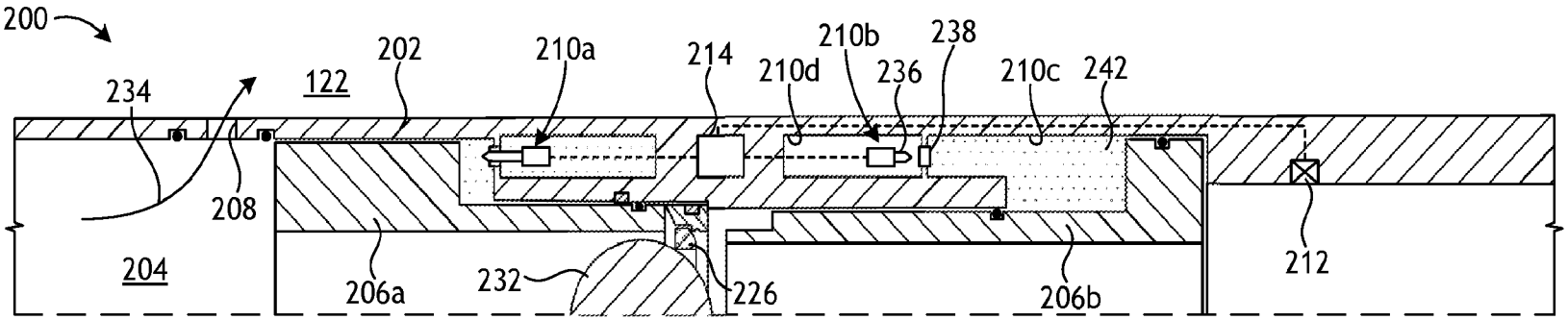

In FIG. 2D, the frac sleeve 206*a* is shown moved fully to the open position and the isolation device 232 continues to provide a sealed interface against the retractable baffle 226. A fluid 234 may then be flowed to the fracturing assembly 200 and into the central flow passage 204 at an elevated pressure to be injected into the annulus 122 via the exposed injection ports 208. The fluid 234 may comprise, for example, a fracturing fluid used to create a network of fractures in the surrounding formation 110 (FIG. 1) during a hydraulic fracturing operation. Alternatively, or in addition thereto, the fluid 234 may comprise a gravel slurry used to fill the annulus 122 during a gravel packing operation.

After hydraulic fracturing operations have finished, it may be desired to move the frac sleeve 206*a* back to the closed position in preparation for production operations or alternatively in preparation for hydraulic fracturing of another zone within the wellbore. To accomplish this, a second frac actuator 210*b* included in the fracturing assembly 200 may be actuated or otherwise operated to move (displace) the closure sleeve 206*b* and thereby move the frac sleeve 206*a* back to the closed position. Similar to the first frac actuator 210*a*, in the illustrated example, the second frac actuator 210*b* includes a piercing member 236 configured to pierce a pressure barrier 238 that initially separates a third chamber 210*c* and a fourth chamber 210*d* each defined in the base pipe 202.

In some embodiments, actuation of the second frac actuator 210*b* to move the closure sleeve 206*b* may be time delayed. More specifically, the electronic circuitry of the electronics module 214 may include a timer that may be triggered (started) upon detection of the predetermined wireless signal used to actuate the first frac actuator 210*a*. In other applications, the timer may be triggered upon detection of a flow rate change through the central flow passage 204, a temperature change from the flow, etc. The timer may be programmed with a predetermined time period for actuating the second frac actuator 206*b* and, upon expiration of the predetermined time period, the electronics module 214 may actuate (operate) the second frac actuator 210*b*. The predetermined time period may be programmed to provide sufficient time to accomplish the hydraulic fracturing operations. For example, the predetermined time period may be about 6 hours, about 12 hours, about 24 hours, about 48 hours, more than 48 hours, or any time range falling therebetween. When the predetermined time period expires, the piercing member 236 is actuated to pierce the pressure barrier 238, and a support fluid 242 (e.g., oil) flows from the third chamber 210*c* to the fourth chamber 210*d*, which generates a pressure differential across the closure sleeve 206*b*. The generated pressure differential urges the closure sleeve 206*b* to move (displace) uphole (i.e., to the left in FIG. 2D) and toward the frac sleeve 206*a* and thereby move the frac sleeve 206*a* back to the closed position.

In other embodiments, however, a second or additional wireless signal may be detected by the sensor 212 to actuate the second frac actuator 210*b*. In such embodiments, the sensor 212 may be positioned uphole from the frac and closure sleeves 206*a,b* and otherwise able to detect signals uphole from the isolation device 232. The sensor 212, however, need not be positioned uphole from the frac and closure sleeves 206*a,b* to detect the additional wireless signal.

Figure 2E:
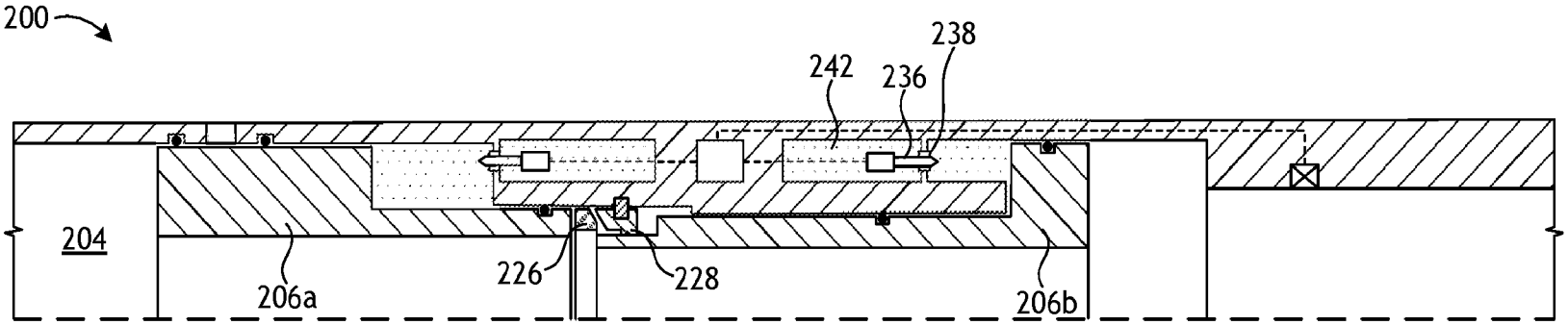

In FIG. 2E, the frac sleeve 206*a* is shown moved back to the closed position by movement of the closure sleeve 206*b*, which is caused by the piercing member 236 penetrating the pressure barrier 238 to allow the support fluid 242 to flow to the fourth chamber 210*d*. As it moves in the uphole direction, the closure sleeve 206*b* axially engages the baffle receiving sleeve 228, which places an uphole axial load on the frac sleeve 206*a* toward the closed position. In some embodiments, an axial extension 240 of the closure sleeve 206*b* may engage the retractable baffle 226 and allow the retractable baffle 226 to radially expand once more to interpose the frac sleeve 206*a* and the baffle receiving sleeve 228. In such embodiments, the isolation device 232 (FIG. 2D) may be released to flow downhole as the retractable baffle 226 radially expands, and thereby clearing the central flow passage 204 for subsequent fluid flow through the fracturing assembly 200.

In other embodiments, the retractable baffle 226 may not be radially expanded as the closure sleeve 206*b* engages the retractable baffle 226 and moves the frac sleeve 206*a* back to closed position. In such embodiments, the isolation device 232 may alternatively be made of a degradable material that allows the isolation device 232 to dissolve over time and thereby clear the central flow passage 204 for subsequent fluid flow through the fracturing assembly 200. Suitable degradable materials for the isolation device 232 include, but are not limited to, a galvanically-corrodible metal (e.g., silver and silver alloys, nickel and nickel alloys, nickel-copper alloys, nickel-chromium alloys, copper and copper alloys, chromium and chromium alloys, tin and tin alloys, aluminum and aluminum alloys, iron and iron alloys, zinc and zinc alloys, magnesium and magnesium alloys, and beryllium and beryllium alloys), micro-galvanic metals or materials (e.g., nano-structured matrix galvanic materials, such as a magnesium alloy with iron-coated inclusions), and a degradable polymer (e.g., polyglycolic acid, polylactic acid, and thiol-based plastics).

Figure 3A:
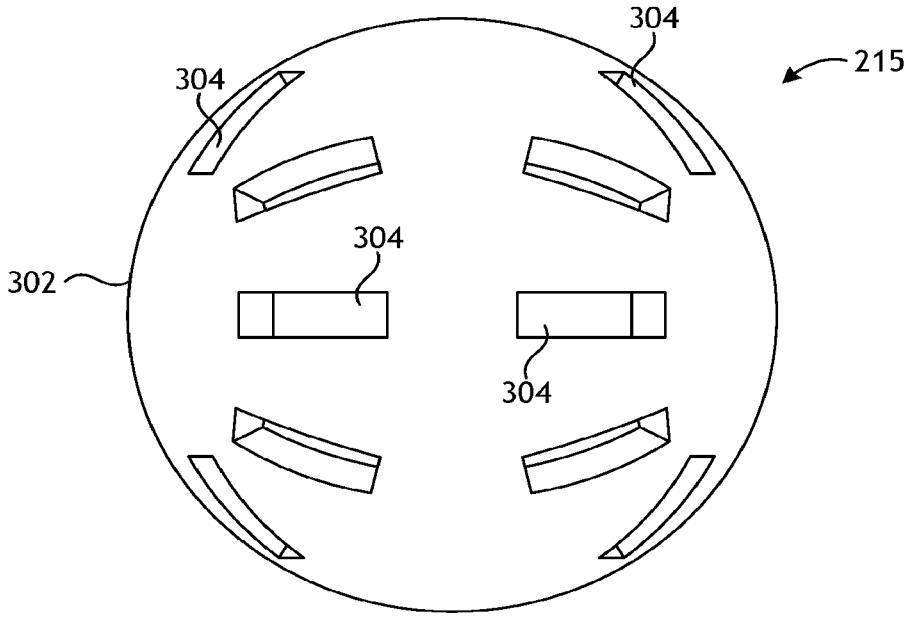
FIGS. 3A and 3B are individual isometric views of an example embodiment of the magnetic projectile of FIG. 2A.
Figure 3B:
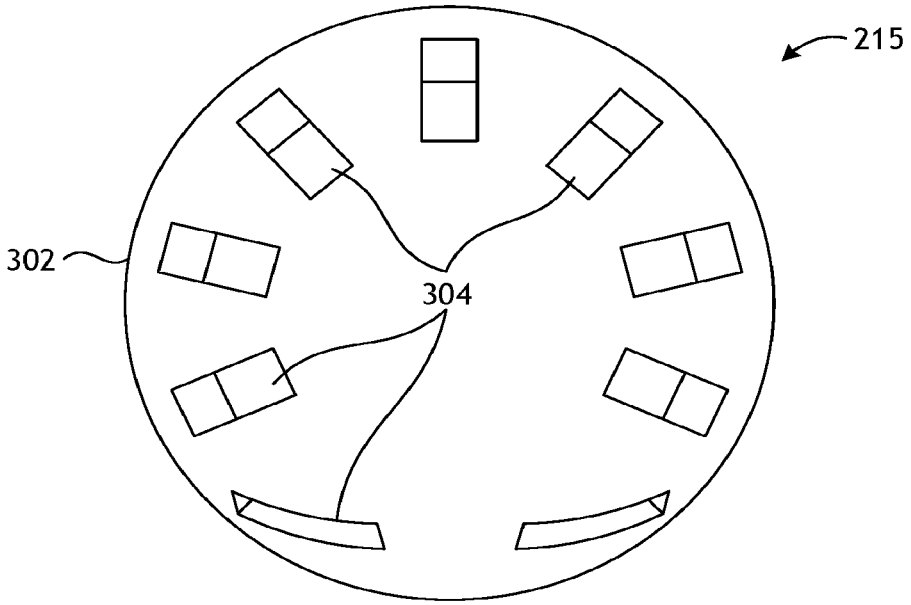

FIGS. 3A and 3B are individual isometric views of an example embodiment of the magnetic projectile 215 of FIG. 2A. In the illustrated embodiment, the magnetic projectile 215 is in the general shape of a sphere 302, such as a frac ball known to those skilled in the art. The sphere 302 may include one or more magnets (not shown in FIGS. 3A and 3B) retained in a plurality of recesses 304 defined in the outer surface of the sphere 302. In other embodiments, however, the magnet(s) of the magnetic projectile 215 may be disposed entirely within the center of the sphere 302, without departing from the scope of the disclosure.

In some embodiments, the recesses 304 may be arranged in a pattern, which, in this case, resembles that of stitching on a baseball. More particularly, the pattern shown in FIGS. 3A and 3B encompasses spaced apart positions distributed along a continuous undulating path about the sphere 302. However, it should be clearly understood that any pattern of magnetic field-producing components may be used in the magnetic projectile 215, in keeping with the scope of this disclosure. Indeed, the magnets may be arranged to provide a magnetic field that extends a predetermined distance from the magnetic projectile 215, and to do so no matter the orientation of the sphere 302. The pattern depicted in FIGS. 3A and 3B may be configured to project the produced magnetic field(s) substantially evenly around the sphere 302.

The first frac actuator 210*a* (FIGS. 2A-2E) may be actuated based on detection of the magnetic projectile 215 or a specific pattern or sequence of magnetic projectiles 215 as detected by the sensor 212 (FIGS. 2A-2E). For example, the first frac actuator 210*a* may be actuated when a first magnetic projectile 215 is displaced into the fracturing assembly 200, or when a predetermined number of magnetic projectiles 215 are detected by the sensor 212. As another example, the first frac actuator 210*a* may be actuated in response to passage of a predetermined amount of time following detection of the particular magnetic projectile 215, a predetermined spacing in time of two or more magnetic projectiles 215, or a predetermined spacing of time between predetermined numbers of magnetic projectiles 215. Thus, conveying a pattern of magnetic projectiles 215 into the fracturing assembly 200 can be used to transmit a corresponding magnetic signal to the first frac actuator 210*a*.

Figure 4A:
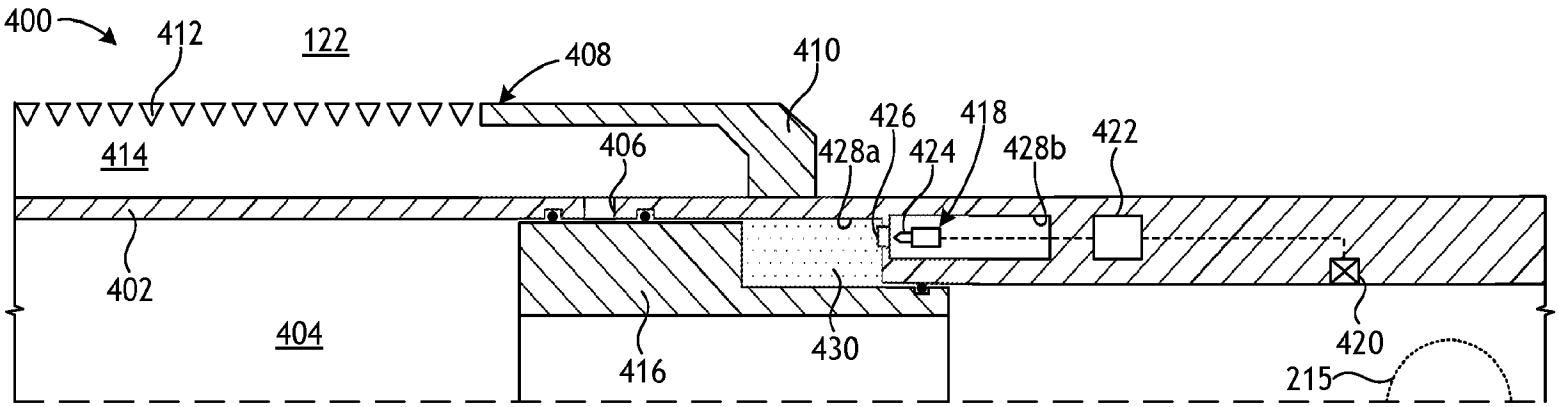
FIGS. 4A and 4B are cross-sectional side views of an example production assembly.
Figure 4B:
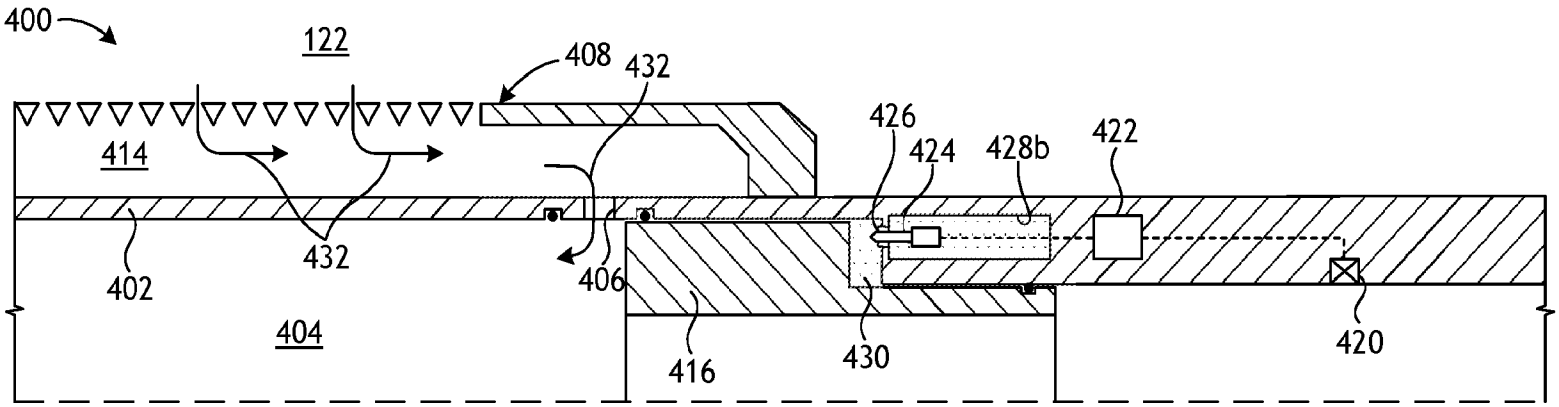

FIGS. 4A and 4B are cross-sectional side views of an example production assembly 400, according to one or more embodiments. The production assembly 400 may be the same as or similar to the any of the production assemblies 120 of FIG. 1 and, therefore, may be included in the completion assembly 114 and used to produce fluids from the annulus 122 and originating from the surrounding subterranean formation 110 (FIG. 1). Moreover, the production assembly 400 may be used in conjunction with the above-described fracturing assembly 200 of FIGS. 2A-2E, such as being arranged in a common completion section of the completion assembly 114. FIGS. 4A-4B depict progressive views of the production assembly 400 during example operation.

In FIG. 4A, the production assembly 400 is depicted as including a base pipe 402 that defines a central flow passage 404 and one or more production ports 406 that facilitate fluid communication between the central flow passage 404 and the annulus 122. The base pipe 402 may be the same as or an axial extension of the base pipe 202 of the fracturing assembly 200 of FIGS. 2A-2E. Accordingly, the central flow passage 404 may fluidly communicate with the central flow passage 204 (FIGS. 2A-2E) of the fracturing assembly 200 and any fluids drawn into the base pipe 402 may be conveyed into the work string 112 (FIG. 1) and transported to a surface location for collection. A filtration device 408 is arranged about the base pipe 402 and, in one embodiment, may extend from an end ring 410 arranged about the base pipe 402 to provide a mechanical interface between the base pipe 402 and the filtration device 408. In other embodiments, however, the end ring 410 may be omitted and the filtration device 408 may alternatively be coupled directly to the base pipe 402.

The filtration device 408 serves as a filter medium designed to allow fluids derived from the formation 110 (FIG. 1) to flow therethrough but substantially prevent the influx of particulate matter of a predetermined size. In some embodiments, as illustrated, the filtration device 408 may comprise one or more well screens 412 arranged about the base pipe 402. As illustrated, the well screen(s) 412 may be radially offset a short distance from the base pipe 402 and thereby define a production annulus 414 therebetween. In other embodiments, however, the well screen(s) 412 may be replaced with a slotted liner, or the like, without departing from the scope of the disclosure.

The well screen(s) 412 may be fluid-porous, particulate restricting devices made from of a plurality of layers of a wire mesh that are diffusion bonded or sintered together to form a fluid porous wire mesh screen. The well screen(s) 412 may alternatively include multiple layers of a weave mesh wire material having a uniform pore structure and a controlled pore size that is determined based upon the properties of the formation 110 (FIG. 1). In other applications, however, the well screen(s) 412 may comprise a single layer of wire mesh, multiple layers of wire mesh that are not bonded together, a single layer of wire wrap, multiple layers of wire wrap or the like, that may or may not operate with a drainage layer.

The production assembly 400 may further include a production sleeve 416 positioned for longitudinal movement within the central flow passage 404. The production ports 406 (one shown) are blocked (occluded) when the production sleeve 416 is in a first or "closed" position, thereby preventing fluid communication between the annulus 122 and the central flow passage 404. As described below, however, the production sleeve 416 is actuatable to move (i.e., displace) to a second or "open" position where the production ports 406 are exposed.

To move the production sleeve 416 to the open position, a production actuator 418 is triggered based on a wireless signal received or otherwise detected by a production sensor 420. The production sensor 420 may be similar to the sensor 212 of FIG. 2A and, therefore, may comprise at least one of a magnetic sensor, an antenna, a pressure sensor, a temperature sensor, an acoustic sensor, a vibration sensor, a strain sensor, an accelerometer, a flow meter, or any combination thereof. Moreover, the production sensor 420 is communicably connected to an electronics module 422 similar to the electronics module 214 of FIGS. 2A-2D. Accordingly, the electronics module 422 may include electronic circuitry configured to determine whether the production sensor 420 has detected a particular wireless signal, and may also include a power supply used to power operation of one or more of the electronics module 422, the production sensor 420, and the production actuator 418.

In embodiments where the production sensor 420 is a magnetic sensor, the electronic circuitry may be configured to determine whether the production sensor 420 has detected a predetermined magnetic field, a pattern or combination of magnetic fields, or another magnetic property of the magnetic projectile 215 introduced into the central flow passage 404. The magnetic projectile 215 may be pumped to or past the production sensor 420 in order to transmit a magnetic signal to the first frac actuator 210*a*. Similar to the electronics module 214 of FIGS. 2A-2D, the electronics module 422 may include a non-volatile memory having a database programmed with a predetermined magnetic field(s) or other magnetic properties for comparison against magnetic fields/properties exhibited by the magnetic projectile 215 and detected by the production sensor 420.

In embodiments where the production sensor 420 is a pressure sensor, predetermined pressure levels or sequences may be programmed into the memory of the electronics module 422 for comparison against an actual fluid pressure or a series (pattern) of pressure changes (fluctuations) detected in the central flow passage 404 by the production sensor 420. Accordingly, to actuate the production actuator 418, a well operator may selectively pressurize the central flow passage 404 to match one of the programmed pressure levels or sequences.

In embodiments where the production sensor 420 is a temperature sensor, a predetermined temperature level or disparity (fluctuation) may be programmed into the memory of the electronics module 422 for comparison against the real-time temperature or temperature fluctuations detected in the central flow passage 404 by the production sensor 420.

In embodiments where the production sensor 420 is an acoustic sensor, predetermined acoustic signatures or acoustic sequences may be programmed into the memory of the electronics module 422 for comparison against noises or a series (pattern) of noise changes detected by the production sensor 420. Such noises may be generated, for example, by axially translating and/or rotating a pipe string or other downhole tool within the wellbore. In other embodiments, however, the noises may comprise acoustic signals transmitted to the production sensor 420 from a remote location, such as the well surface. In yet other embodiments, the noise may be generated by fluid movement.

If the electronics module 422 determines that the production sensor 420 has detected a predetermined wireless signal, the electronic circuitry triggers actuation of the production actuator 418 to cause the production sleeve 416 to move to the open position and thereby expose the production ports 406. In some embodiments, as illustrated, the production actuator 418 may be similar to one or both of the first and second frac actuators 210*a,b* of FIGS. 2A-2E. More specifically, the production actuator 418 includes a piercing member 424 configured to pierce a pressure barrier 426 that initially separates a first chamber 428*a* and a second chamber 428*b* defined by the base pipe 402. When the production sensor 420 detects the predetermined wireless signal, the piercing member 424 is triggered to pierce the pressure barrier 426, and a support fluid 430 (e.g., oil) flows from the first chamber 428*a* to the second chamber 428*b*, which generates a pressure differential across the production sleeve 416. The generated pressure differential urges the production sleeve 416 to move (displace) toward the open position.

In FIG. 4B, the production actuator 418 is shown actuated as the piercing member 424 has pierced the pressure barrier 426 such that the support fluid 430 in the first chamber 428*a* is able to escape into the second chamber 428*b* and the resulting pressure differential has moved the production sleeve 416 to the open position. In the open position, a fluid 432 from the annulus 122 may be drawn through the filtration device 408 and into the production annulus 414. The fluid 432 may traverse the exterior of the base pipe 402 within the production annulus 414 until locating the production ports 406, which allow the fluid 432 to enter the central flow passage 404 for production to the well surface.

In some embodiments, actuation of the production sleeve 416 may be time delayed. More specifically, the electronic circuitry of the electronics module 422 may include a timer that may be triggered (started) upon detection of the predetermined wireless signal with the production sensor 420. The timer may be programmed with a predetermined time period for actuating the production actuator 418 and, upon expiration of the predetermined time period, the electronics module 422 may send a signal that actuates (operates) the production actuator 418. The predetermined time period may provide sufficient time to accomplish the preceding hydraulic fracturing operations described above with reference to the fracturing assembly 200 of FIGS. 2A-2E. The predetermined time period may be about 6 hours, about 12 hours, about 24 hours, about 48 hours, more than 48 hours, or any time range falling therebetween.

Figure 5:
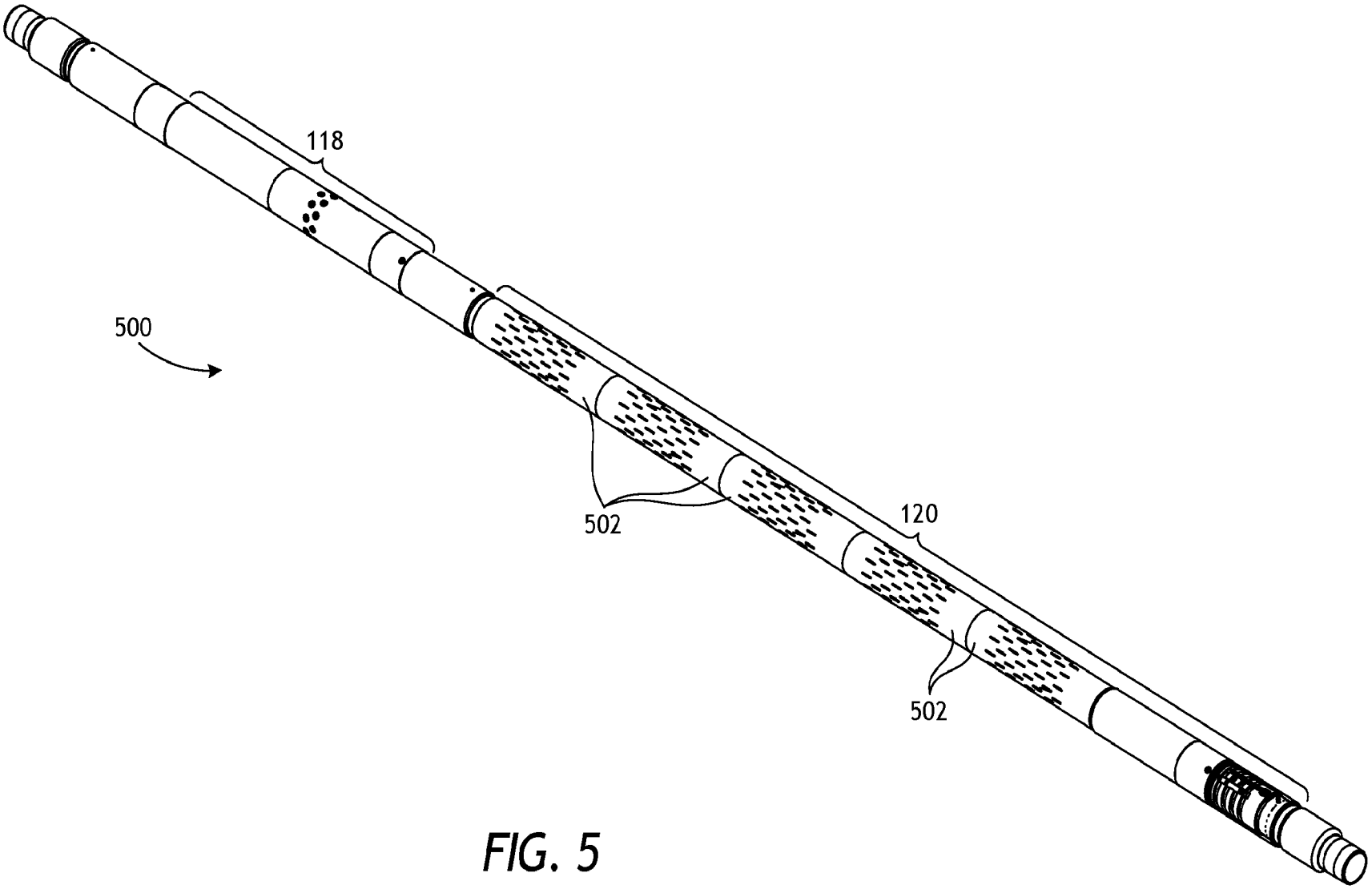
FIG. 5 is an isometric view of an example completion section that may form part of the completion assembly of FIG. 1, according to one or more embodiments.

FIG. 5 is an isometric view of an example completion section 500 that may form part of the completion assembly 114 of FIG. 1, according to one or more embodiments. The completion section 500 may be generally located between axially adjacent wellbore packers 116 (FIG. 1) and include a fracturing assembly 118 and a production assembly 120 axially offset from the fracturing assembly 118. The production assembly 120 includes a plurality of filtration devices 502 used to prevent the influx of particulate matter of a predetermined size. In the illustrated embodiment, the filtration devices 502 are in the form of slotted liners 502, but could alternatively comprise sand screens or another type of downhole filtration system, without departing from the scope of the disclosure.

Figure 6A:
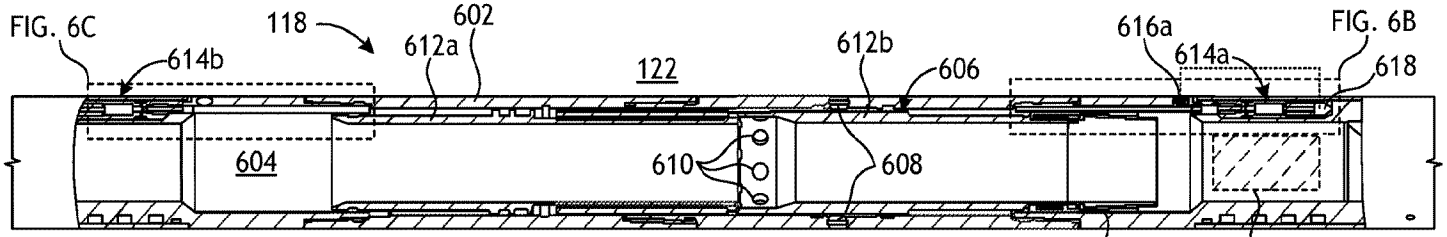
FIG. 6A is a partial cross-sectional side view of the fracturing assembly of FIG. 5.

FIG. 6A is a partial cross-sectional side view of the fracturing assembly 118 of FIG. 5, according to one or more embodiments. As mentioned above, the fracturing assembly 118 may be used to inject a fluid into the annulus 122 defined between the completion assembly 114 (FIG. 1) and the wellbore 102 (FIG. 1). The fracturing assembly 118 includes a base pipe 602 that defines a central flow passage 604 in fluid communication with the work string 112 (FIG. 1) such that fluids and objects (e.g., wellbore projectiles) conveyed into the wellbore 102 via the work string 112 will communicate with (flow into) the central flow passage 604.

The fracturing assembly 118 further includes a frac sleeve 606 positioned for longitudinal movement within the central flow passage 604. One or more injection ports 608 (two shown) are defined in the wall of the base pipe 602 200 and are blocked (occluded) when the frac sleeve 606 is in a first or "closed" position, thereby preventing fluid communication between the annulus 122 and the central flow passage 604. As discussed below, the frac sleeve 606 is actuatable to move (i.e., displace) to a second or "open" position where fluid communication between the annulus 122 and the central flow passage 604 is facilitated. In the illustrated embodiment, fluid communication is facilitated by aligning one or more frac ports 610 defined in the frac sleeve 606 with the injection ports 608.

In some embodiments, as illustrated, the frac sleeve 606 may comprise two sleeve sections, shown as an upper sleeve section 612*a* and a lower sleeve section 612*b*. As illustrated, the frac ports 610 are defined in the lower sleeve section 612*b*. Moreover, as described below, the upper and lower sleeve sections 612*a,b* may be able to translate a short distance relative to one another within the central flow passage 604.

The fracturing assembly 118 further includes a first frac actuator 614*a* and a second frac actuator 614*b*. To move the frac sleeve 606 to the open position, the first frac actuator 614*a* is triggered, and to move the frac sleeve 606 back to the closed position, the second frac actuator 614*b* is triggered. The first frac actuator 614*a* may be triggered based on a wireless signal detected by a first sensor 616*a* coupled to the wall of the base pipe 602. The first sensor 616*a* may be similar to the sensor 212 of FIG. 2A and, therefore, may comprise at least one of a magnetic sensor, an antenna, a pressure sensor, a temperature sensor, an acoustic sensor, a vibration sensor, a strain sensor, an accelerometer, a flow meter, or any combination thereof. While the first sensor 616*a* is shown located downhole from the frac sleeve 606, the first sensor 616*a* could alternatively be located uphole from the frac sleeve 606, without departing from the scope of the disclosure.

The first sensor 616*a* may be communicably connected to an electronics module 618 similar to the electronics module 214 of FIGS. 2A-2D. Accordingly, the electronics module 618 may include electronic circuitry configured to determine whether the first sensor 616*a* has detected a particular wireless signal, and may also include a power supply used to power operation of one or more of the electronics module 618, the first sensor 616*a*, and the first frac actuator 614*a*.

In embodiments where the first sensor 616*a* is a magnetic sensor, the electronic circuitry may be configured to determine whether the first sensor 616*a* has detected a predetermined magnetic field, a pattern or combination of magnetic fields, or another magnetic property of a magnetic projectile 620 introduced into the central flow passage 404. The magnetic projectile 620 may be the same as or similar to the magnetic projectile 215 of FIGS. 2A and 4A and, therefore, may comprise a ball, a dart, a plug, a fluid, a gel, a pill or slurry of magnetic particles, or any other device or substance that exhibits a magnetic property detectable by the first sensor 616*a*. The electronics module 618 may also include a non-volatile memory having a database programmed with a predetermined magnetic field(s) or other magnetic properties for comparison against magnetic fields/properties exhibited by the magnetic projectile 620 and detected by the first sensor 616*a*.

In embodiments where the first sensor 616*a* is a pressure sensor, a temperature sensor, or an acoustic sensor, actuation of the first frac actuator 614*a* may be triggered and otherwise undertaken as generally described above with reference to operation of the sensor 212 of FIG. 2A and, therefore, will not be described again.

Figure 6B:
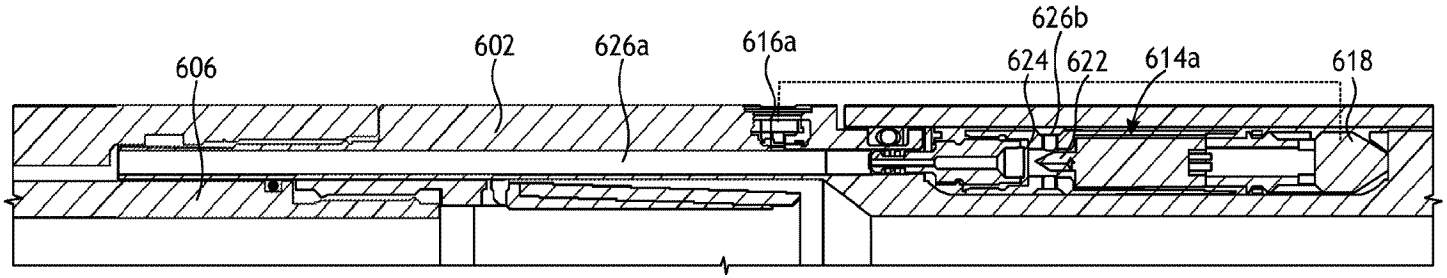
FIGS. 6B and 6C are enlarged cross-sectional side views of the first and second frac actuators of FIG. 6A, respectively, as indicated by the dashed boxes in FIG. 6A.
Figure 6C:
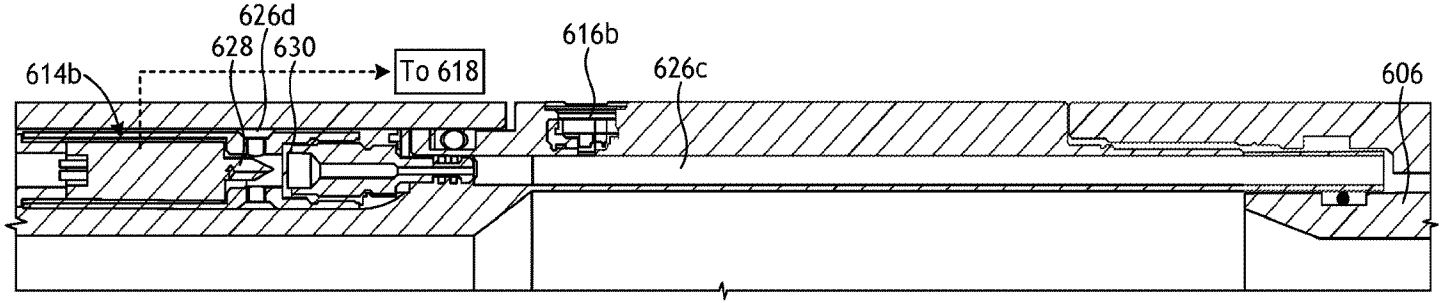

FIGS. 6B and 6C are enlarged cross-sectional side views of the first and second frac actuators 614*a,b*, respectively, as indicated by the dashed boxes of FIG. 6A. Similar to the actuators discussed above, the first and second frac actuators 614*a,b* can each comprise any type of actuator (e.g., electrical, hydraulic, mechanical, explosive, chemical, a combination thereof, etc.) used to advance a piercing member towards a pressure barrier upon actuation. In FIG. 6B, for example, the first frac actuator 614*a* includes a piercing member 622 operable to pierce a pressure barrier 624 that initially separates a first chamber 626*a* and a second chamber 626*b* each defined in the base pipe 602. When the first sensor 616*a* detects the predetermined wireless signal, a command signal may be sent to the first frac actuator 614*a* to pierce the pressure barrier 624 with the piercing member 622, which allows a support fluid (e.g., oil) to flow from the first chamber 626*a* to the second chamber 626*b* and generate a pressure differential across the frac sleeve 606. The generated pressure differential urges the frac sleeve 606 to move (displace) toward the open position (i.e., to the right in FIGS. 6A and 6B).

In FIG. 6C, the second frac actuator 614*b* also includes a piercing member 628 operable to pierce a pressure barrier 630 that initially separates a third chamber 626*c* and a fourth chamber 626*d* each defined in the base pipe 602. In some embodiments, the second frac actuator 614*b* may be actuated when a second sensor 616*b* detects a predetermined wireless signal. The second sensor 616*b* may be similar to the first sensor 616*a* and, therefore, may comprise at least one of a magnetic sensor, an antenna, a pressure sensor, a temperature sensor, an acoustic sensor, a vibration sensor, a strain sensor, an accelerometer, a flow meter, or any combination thereof. Moreover, the second sensor 616*b* may be communicably coupled to an electronics module (not shown) associated with the second frac actuator 614*b*.

In other embodiments, however, the second frac actuator 614*b* may be communicably coupled to the electronics module 618 (FIGS. 6A and 6B) of the first frac actuator 614*a* (FIGS. 6A and 6B) and may operate based on a time delay. More specifically, the electronic circuitry of the electronics module 618 may include a timer that may be triggered (started) upon detection of the predetermined wireless signal used to actuate the first frac actuator 614*a*. The timer may be programmed with a predetermined time period for actuating the second frac actuator 614*b* and, upon expiration of the predetermined time period, the electronics module 618 may send a command signal to actuate (operate) the second frac actuator 614*b*. The predetermined time period may be programmed to provide sufficient time to accomplish the hydraulic fracturing operations. For example, the predetermined time period may be about 6 hours, about 12 hours, about 24 hours, about 48 hours, more than 48 hours, or any time range falling therebetween. When the predetermined time period expires, the piercing member 628 is actuated to pierce the pressure barrier 630, and a support fluid (e.g., oil) flows from the third chamber 626*c* to the fourth chamber 626*d*, which generates a pressure differential across the frac sleeve 606. The generated pressure differential urges the frac sleeve 606 to move (displace) uphole (i.e., to the left in FIGS. 6 and 6B) and thereby back to the closed position.

Figure 6D:
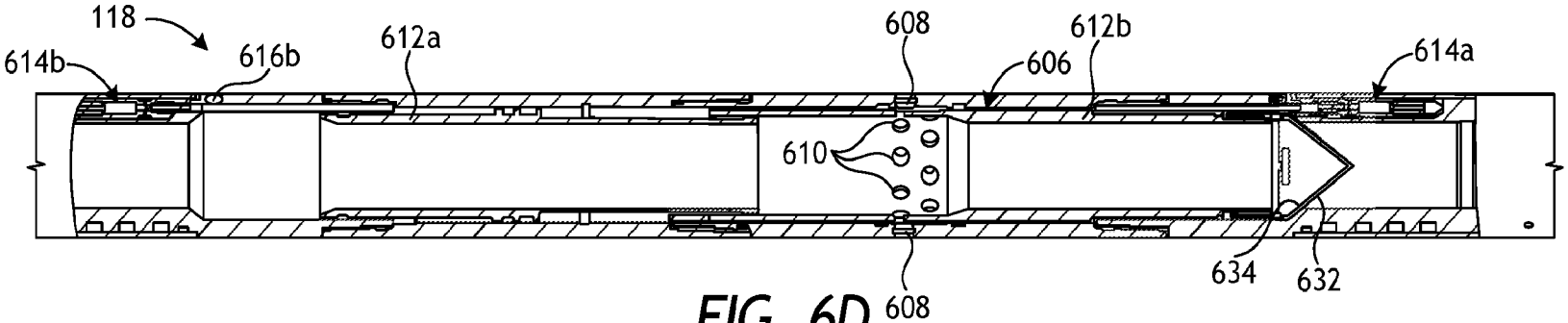
FIGS. 6D and 6E depict progressive views of the fracturing assembly of FIG. 6A during example operation.
Figure 6E:
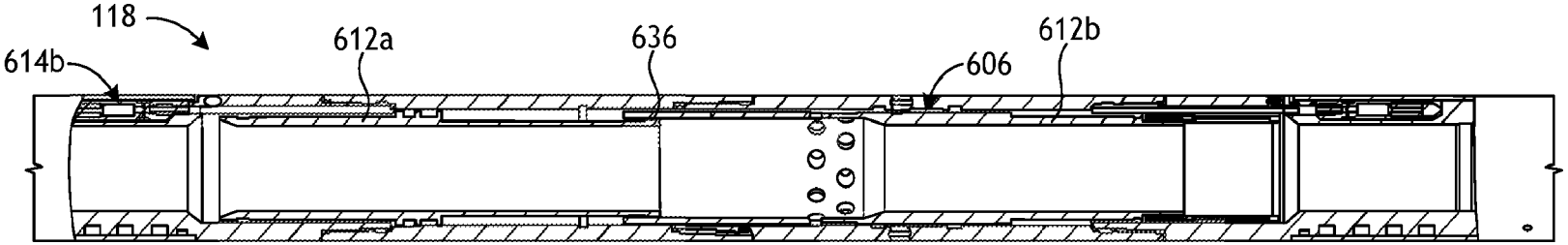

Operation of the fracturing assembly 118 will now be provided with reference to FIGS. 6A, 6D, and 6E, which depict progressive views of the fracturing assembly 118 during example operation. In FIG. 6A, the fracturing assembly 118 is shown in the closed position, where the frac sleeve 606 occludes the injection ports 608 and thereby prevents fluid communication between the annulus 122 and the central flow passage 604. Once the predetermined wireless signal is detected by the first sensor 616*a*, however, the first frac actuator 614*a* may be triggered to move the frac sleeve 606 toward the open position (i.e., to the right in FIG. 6A).

In some embodiments, as illustrated, the fracturing assembly 118 may further include an isolation device 632 positioned within the central flow passage 604 and used to isolate the fracturing assembly 118 from downhole portions of the completion section 500 (FIG. 5). In the illustrated embodiment, the isolation device 632 is in the form of a collapsible sand trap or diverter coupled to the distal end of the frac sleeve 606. The sand diverter is depicted in FIG. 6A in an open position that allows fluid communication through the central flow passage 604. Upon moving the frac sleeve 606 to the closed position, however, the sand diverter may be configured to collapse radially and at least partially seal the central flow passage 606, as described below.

In FIG. 6D, the first frac actuator 614*a* is shown actuated, as described above, and the resulting pressure differential across the frac sleeve 606 has moved the frac sleeve 606 to the open position where the injection ports 608 are exposed via the frac ports 610 defined in the frac sleeve 606. In the illustrated embodiment, moving the frac sleeve 606 to the open position moves the lower sleeve section 612*b* while the upper sleeve section 612*a* remains relatively stationary. In other embodiments, however, the frac sleeve 606 may comprise a monolithic structure that moves as a unitary sleeve construction, without departing from the scope of the disclosure.

Moving the frac sleeve 606 to the open position may also result in full or partial isolation of the central flow passage 604 below the injection ports 608 as the isolation device 632 collapses to its closed position. As indicated above, the isolation device 632 may comprise a sand diverter. As the frac sleeve 606 moves to the right in FIG. 6D and toward the open position, the sand diverter will eventually engage a radial shoulder 634 configured to deflect and collapse the sand diverter. In some embodiments, the sand diverter may provide a seal within the central flow passage 604. In other embodiments, however, the sand diverter may simply prevent passage of particulate matter. The sand diverter may prove advantageous in vertical wells, for example, where sand, proppant, and gravel particulates from a gravel slurry or fracturing fluid might migrate downhole past the fracturing assembly 118 during a hydraulic fracturing operation. The sand diverter may serve to prevent migration of such particulate matter.

With the frac sleeve 606 in the open position, a fluid (e.g., a fracturing fluid, a gravel slurry, etc.) may then be flowed to the fracturing assembly 118 and into the central flow passage 604 at an elevated pressure to be injected into the annulus 122 via the exposed injection ports 608.

After hydraulic fracturing operations have finished, it may be desired to move the frac sleeve 606 back to the closed position in preparation for production operations undertaken by the production assembly 120 (FIG. 5) or in preparation for fracturing operations of another zone in the wellbore. To accomplish this, the second frac actuator 614*b* may be actuated as generally described above. In some embodiments, as discussed above, actuation of the second frac actuator 614*b* may be time delayed following detection of the first wireless signal by the first sensor 612*a*. In other embodiments, actuation of the second frac actuator 614*b* may be triggered following detection of a second or additional wireless signal detected by the second sensor 616*b*. In yet other embodiments, actuation of the second frac actuator 614*b* may be triggered following detection of the second wireless signal detected by the second sensor 616*b* and after a predetermined time delay sufficient to allow the fracturing operation to conclude.

In FIG. 6E, the frac sleeve 606 is shown moved back to the closed position following actuation of the second frac actuator 614*b*, as generally described above. In the illustrated embodiment, moving the frac sleeve 606 to the closed position first moves the upper sleeve section 612*a*, which eventually engages a portion of the lower sleeve section 612*b* at a radial shoulder 636 and thereafter pulls the lower sleeve section 612*b* as well. Again, in other embodiments, the frac sleeve 606 may comprise a monolithic structure that moves as a unitary sleeve construction, without departing from the scope of the disclosure.

As the frac sleeve 606 moves back to the closed position, the isolation device 632 moves out of engagement with the radial shoulder 634 and allows the isolation device 632 to radially expand once again to the open position. Radial expansion of the isolation device 632 may be facilitated through one or more torsion springs associated with the isolation device 632. In other embodiments, however, the isolation device 232 may alternatively be made of a degradable material (e.g., any of the degradable materials mentioned above) that allows the isolation device 232 to dissolve over time and thereby clear the central flow passage 604 for subsequent fluid flow through the fracturing assembly 118.

Figure 7A:
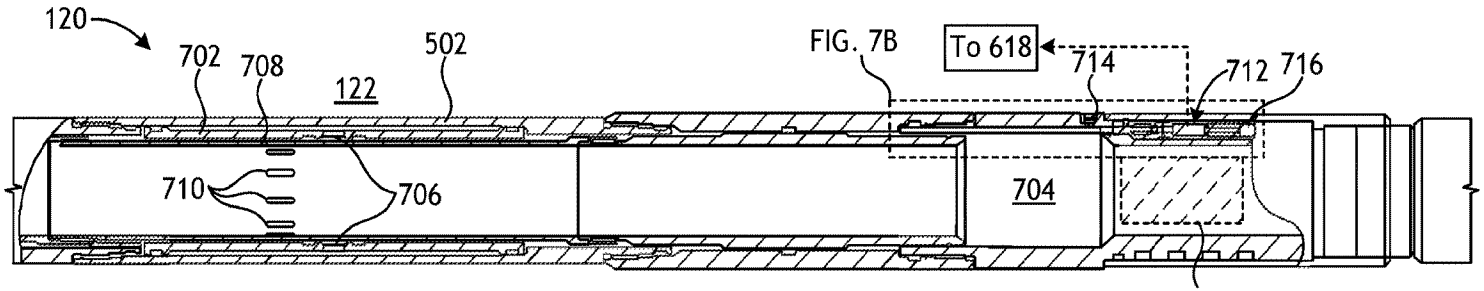
FIG. 7A is a partial cross-sectional side view of the production assembly of FIG. 5.

FIG. 7A is a partial cross-sectional side view of the production assembly 120 of FIG. 5, according to one or more embodiments. As mentioned above, the production assembly 120 may be used to produce fluids from the annulus 122 and originating from the surrounding subterranean formation 110 (FIG. 1). The production assembly 120 is depicted as including a base pipe 702 that defines a central flow passage 704 and one or more production ports 706 that facilitate fluid communication between the central flow passage 704 and the annulus 122. The base pipe 702 may be the same as or an axial extension of the base pipe 602 of the fracturing assembly 118 of FIGS. 6A-6E. Accordingly, the central flow passage 704 may fluidly communicate with the central flow passage 604 (FIGS. 2A-2E) of the fracturing assembly 118 and any fluids drawn into the base pipe 702 may be conveyed into the work string 112 (FIG. 1) and transported to a surface location for collection.

One of the filtration devices 502 of FIG. 5 is depicted in FIG. 7A as arranged about the base pipe 702. The filtration device 502 serves as a filter medium designed to allow fluids derived from the surrounding formation 110 (FIG. 1) to flow therethrough but substantially prevent the influx of particulate matter of a predetermined size. As illustrated, the filtration device 502 may be radially offset a short distance from the base pipe 702 and thereby define a production annulus therebetween.

The production assembly 120 further includes a production sleeve 708 positioned for longitudinal movement within the central flow passage 704. The production ports 706 (one shown) are blocked (occluded) when the production sleeve 708 is in a first or "closed" position, thereby preventing fluid communication between the annulus 122 and the central flow passage 704. The production sleeve 708, however, is actuatable to move (i.e., displace) to a second or "open" position where the production ports 706 are exposed via one or more influx ports 710 defined in the production sleeve 708.

To move the production sleeve 708 to the open position, a production actuator 712 is triggered based on a wireless signal. In some embodiments, the wireless signal may be the same wireless signal used to actuate the first frac actuator 614*a* of FIGS. 6A-6E, and actuation of the production actuator 712 may be based on a time delay sufficient to allow the hydraulic fracturing operations to terminate. In such embodiments, the production actuator 712 may be communicably coupled to the electronics module 618 (FIGS. 6A and 6B). In other embodiments, however, the wireless signal may comprise a second or additional wireless signal received or otherwise detected by a production sensor 714. The production sensor 714 may be similar to the sensor 212 of FIG. 2A and, therefore, may comprise at least one of a magnetic sensor, an antenna, a pressure sensor, a temperature sensor, an acoustic sensor, a vibration sensor, a strain sensor, an accelerometer, a flow meter, or any combination thereof. While the production sensor 714 is shown located downhole from the production sleeve 708, the production sensor 714 could alternatively be located uphole from the production sleeve 708, without departing from the scope of the disclosure.

The production sensor 714 may be communicably connected to an electronics module 716 similar to the electronics module 214 of FIGS. 2A-2D. Accordingly, the electronics module 716 may include electronic circuitry configured to determine whether the production sensor 714 has detected a particular wireless signal, and may also include a power supply used to power operation of one or more of the electronics module 716, the production sensor 714, and the production actuator 712.

In embodiments where the production sensor 714 is a magnetic sensor, the electronic circuitry may be configured to determine whether the production sensor 714 has detected a predetermined magnetic field, a pattern or combination of magnetic fields, or another magnetic property of a magnetic projectile 718 introduced into the central flow passage 704. The magnetic projectile 718 may be the same as or similar to the magnetic projectile 620 of FIG. 6A and, therefore will not be described again. The electronics module 716 may also include a non-volatile memory having a database programmed with a predetermined magnetic field(s) or other magnetic properties for comparison against magnetic fields/properties exhibited by the magnetic projectile 718 and detected by the production sensor 714.

In embodiments where the production sensor 714 is a pressure sensor, a temperature sensor, or an acoustic sensor, actuation of the production actuator 712 may be triggered and otherwise undertaken as generally described above with reference to operation of the sensor 212 of FIG. 2A and, therefore, will not be described again.

If the electronics module 716 determines that the production sensor 714 has detected a predetermined wireless signal, the electronic circuitry triggers actuation of the production actuator 712 to cause the production sleeve 708 to move to the open position and thereby expose the production ports 706.

Figure 7B:
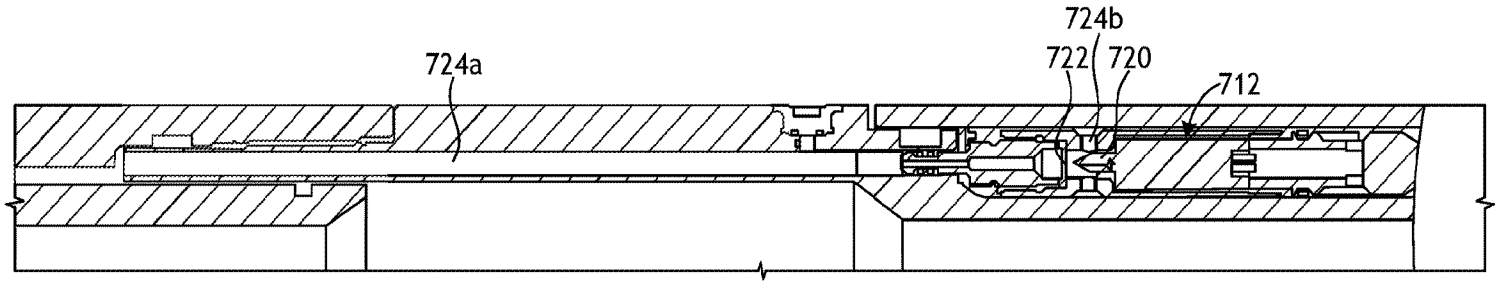
FIG. 7B is an enlarged cross-sectional side view of the production actuator of FIG. 7A, as indicated by the dashed box in FIG. 7A.

FIG. 7B is an enlarged cross-sectional side view of the production actuator 712, according to one or more embodiments. As illustrated, the production actuator 712 includes a piercing member 720 configured to pierce a pressure barrier 722 that initially separates a first chamber 724*a* and a second chamber 724*b* defined by the base pipe 702. When the production sensor 714 detects the predetermined wireless signal (or when a command signal is sent to the production actuator 712 from the electronics module 618 of FIGS. 6A and 6B), the production actuator 712 is actuated to penetrate the pressure barrier 722 with the piercing member 720. Penetrating the pressure barrier 722 allows a support fluid (e.g., oil) to flow from the first chamber 724*a* to the second chamber 724*b*, which generates a pressure differential across the production sleeve 708, and the generated pressure differential urges the production sleeve 708 to move (displace) toward the open position.

Figure 7C:
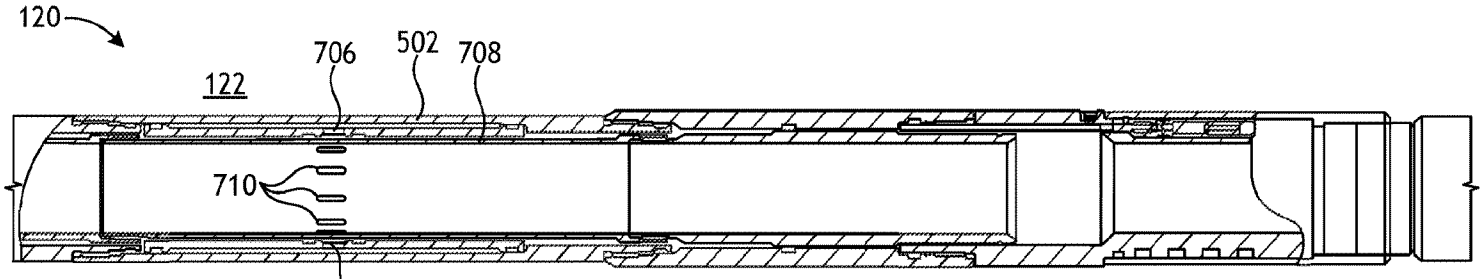
FIG. 7C is a cross-sectional side view of the production assembly of FIG. 7A with the production sleeve moved to the open position.

FIG. 7C is a cross-sectional side view of the production assembly 120 with the production sleeve 708 moved to the open position. The production actuator 712 is shown actuated in FIG. 7C and the production sleeve 708 has moved within the central flow passage 704 to the open position where the influx ports 710 align with the production ports 706. In the open position, fluids from the annulus 122 may be drawn through the filtration device 502 and into the production annulus until locating the production ports 706, which allow the fluid to enter the central flow passage 704 via the influx ports 710 for production to the well surface.

Figure 8A:
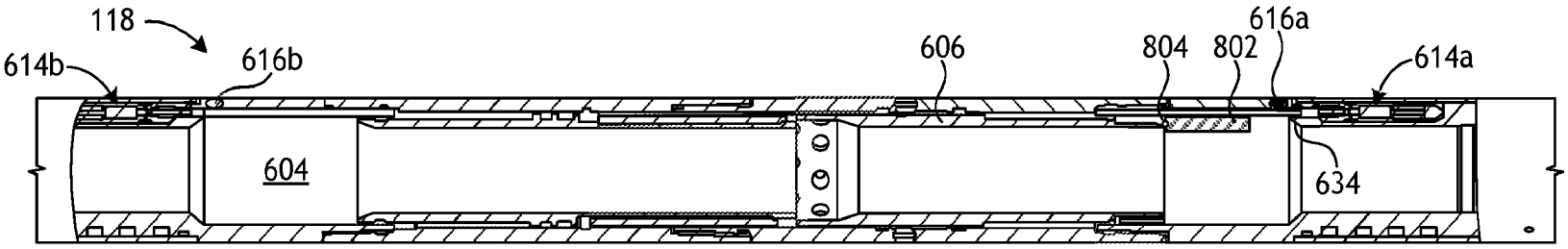
FIGS. 8A and 8B are cross-sectional side views of an alternate embodiment of the fracturing assembly of FIGS. 6A-6E.
Figure 8B:
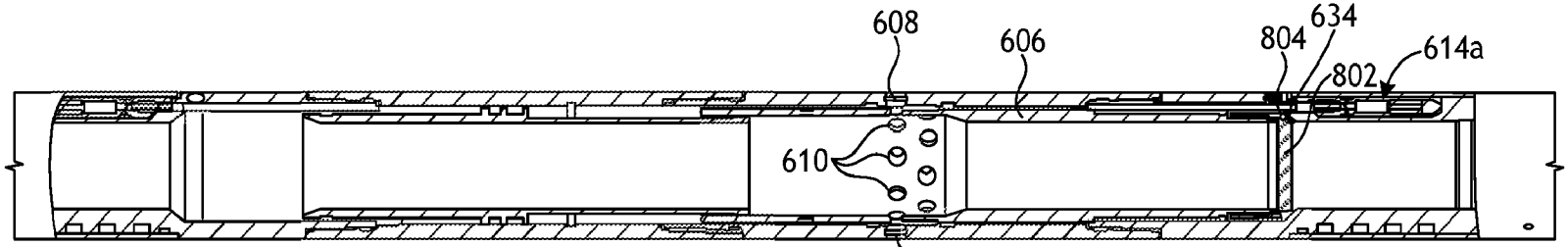

FIGS. 8A and 8B are cross-sectional side views of an alternate embodiment of the fracturing assembly 118 of FIGS. 6A-6E. Similar to the embodiment of FIGS. 6A-6E, the fracturing assembly 118 includes the frac sleeve 606, the first and second frac actuators 614*a,b*, and at least the first sensor 616*a* (alternately including also the second sensor 616*b*). Unlike the embodiment of FIGS. 6A-6E, however, the fracturing assembly 118 may further include an isolation device 802 in the form of a flapper or flapper valve. The isolation device 802 is positioned within the central flow passage 604 and used to isolate the fracturing assembly 118 from downhole portions of the completion section 500 (FIG. 5). In some embodiments, the isolation device 802 may be coupled to the distal end of the frac sleeve 606 at a pivot point 804, such as a torsion spring. In other embodiments, however, the isolation device 802 may be coupled to or otherwise carried by the base pipe 602, without departing from the scope of the disclosure.

In FIG. 8A, the isolation device 802 is depicted in an open position that allows fluid communication through the central flow passage 604. Upon moving the frac sleeve 606 to the closed position, however, the flapper isolation device 802 may be configured to pivot at the pivot point 804 to a closed position and at least partially seal the central flow passage 606.

In FIG. 8B, the frac sleeve 606 has moved to the open position where the injection ports 608 are exposed via the frac ports 610 defined in the frac sleeve 606. Moving the frac sleeve 606 to the open position also results in full or partial isolation of the central flow passage 604 below the injection ports 608 as the isolation device 802 pivots to the closed position. More particularly, as the frac sleeve 606 moves to the right in FIG. 8D and toward the open position, the distal end of the flapper isolation device 802 will eventually engage the radial shoulder 634, which deflects the flapper to its closed position. Upon moving the frac sleeve 606 back to the closed position, as described above, the flapper isolation device 802 may be configured to pivot back to the open position. In such embodiments, the torsion spring at the pivot point 804 may provide the necessary force required to pivot the isolation device 802 to the open position.

Embodiments are also contemplated herein where the isolation device 802 (in any form) is entirely omitted from the fracturing assembly 118. In such embodiments, the fracturing and production assemblies 118, 120 may operate as generally described herein, an hydraulic fracturing at the fracturing assembly 118 may be undertaken since the remaining fracturing assemblies in the completion string 114 (FIG. 1) will be closed and the distal end of the completion string 114 will also be closed. Consequently, the hydraulic pressure required for the fracturing operation can occur without the need for an isolation device 802 (in any form) used to isolate the fracturing assembly 118 from downhole portions of the completion string 114. In such embodiments, a well operator may be able to fracture and produce desired portions of a surrounding subterranean formation 110 (FIG. 1) by selectively actuating desired fracturing and completion assemblies 118, 120.

Embodiments are also contemplated herein where an intervention or shifting tool may be used to manually (physically) shift one or both of the frac and production sleeves between open and closed positions. This may be required in the event an associated actuation device fails or is otherwise unable to properly actuate the frac and production sleeves, such as when debris or other downhole obstructions prevent proper actuation. In such embodiments, the frac and production sleeves described herein will have corresponding shifting profiles configured to receive a profile of the shifting tool. Once the profiles mate, axial loads may be applied on the frac and production sleeves to move between the open and closed positions.

It is noted that the frac and production actuators described herein are not limited to using piercing members configured to pierce or penetrate a pressure barrier. Rather, it is also contemplated herein to replace the described piercing members with a valve. In such embodiments, the valve may include a rod similar to the piercing members, but including one or more seals (e.g., O-rings) disposed about the rod. The rod may be extended into a conduit to generate a seal between adjacent fluid chambers. To enable fluid communication between the adjacent fluid chambers, and thereby actuate a frac sleeve or a production sleeve, the frac or production actuator may be actuated. Alternatively, the force required to push the rod out of the conduit (i.e., retract it) may be provided by fluid pressure pushing on the end of the rod.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM, and flash EPROM.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A tubular section for a downhole assembly, comprising:

a base pipe that defines a central flow passage, one or more injection ports, and one or more production ports;

a first sleeve positioned within the central flow passage adjacent the one or more injection ports;

a sensor that detects a wireless signal;

a first actuator communicably coupled to the first sleeve at a first location, actuatable in response to the wireless signal to move the first sleeve toward an open position where the one or more injection ports are exposed; and a second actuator, communicably coupled to the first sleeve at a second location, actuatable based on the wireless signal to move the first sleeve to a closed position where the first sleeve occludes the one or more injection ports; and a second sleeve positioned within the central flow passage adjacent the one or more production ports; and a production actuator actuatable based on the wireless signal to move the second sleeve to an open position where the one or more production ports are exposed.

2. The tubular section of claim 1, wherein the wireless signal is selected from the group consisting of a magnetic field, an electromagnetic signal, a pressure signal, a temperature signal, an acoustic signal, a fluid flowrate signal, and any combination thereof.

3. The tubular section of claim 1, wherein the sensor is selected from the group consisting of a magnetic sensor, an antenna, a pressure sensor, a temperature sensor, an acoustic sensor, a vibration sensor, a strain sensor, an accelerometer, a flow meter, and any combination thereof.

4. The tubular section of claim 1, wherein the wireless signal comprises a magnetic field generated by a magnetic projectile introduced into the central flow passage.

5. The tubular section of claim 1, wherein actuation of the second actuator is triggered following expiration of a predetermined time period after detection of the wireless signal.

6. The tubular section of claim 1, wherein actuation of the production actuator is triggered following expiration of a predetermined time period after detection of the wireless signal or upon detection of an additional wireless signal.

7. The tubular section of claim 1, further comprising an isolation device positioned within the central flow passage to isolate the first sleeve and the first actuator from downhole portions of the section when the first sleeve is moved to the open position.

8. The tubular section of claim 1, further comprising a closure sleeve positioned within the central flow passage axially adjacent the first sleeve, and wherein actuation of the second actuator causes the closure sleeve to translate within the central flow passage and move the first sleeve to the closed position.

9. The tubular section of claim 1, comprising another sensor that detects an additional wireless signal to actuate the production actuator, the additional wireless signal being selected from the group consisting of a magnetic field, an electromagnetic signal, a pressure signal, a temperature signal, an acoustic signal, a fluid flowrate signal, and any combination thereof.

10. A method, comprising:

positioning a tubular string within a wellbore, the tubular string including at least one tubular section that includes:

a base pipe that defines a central flow passage, one or more injection ports, and one or more production ports;

a first sleeve positioned within the central flow passage adjacent the one or more injection ports, a sensor, a first actuator, communicably coupled to the first sleeve at a first location, and a second actuator, communicably coupled to the first sleeve at a second location; and a second sleeve positioned within the central flow passage adjacent the one or more production ports, and a third actuator;

detecting a wireless signal with the sensor;

actuating the first actuator in response to the wireless signal and thereby moving the first sleeve toward an open position where the one or more injection ports are exposed;

actuating the second actuator based on the wireless signal and thereby moving the first sleeve to a closed position where first sleeve occludes the one or more injection ports; and actuating the third actuator based on the wireless signal or in response to detection of an additional wireless signal to move the production sleeve to an open position where the one or more production ports are exposed.

11. The method of claim 10, wherein detecting the wireless signal with the sensor comprises:

introducing a magnetic projectile into the central flow passage; and detecting a magnetic field generated by the magnetic projectile with the sensor.

12. The method of claim 10, wherein actuating the second actuator based on the wireless signal comprises triggering actuation of the second actuator upon an expiration of a predetermined time period after detection of the wireless signal.

13. The method of claim 10, wherein actuating the third actuator comprises triggering actuation of the third actuator upon an expiration of a predetermined time period after detection of the wireless signal or the additional wireless signal.

14. The method of claim 10, further comprising isolating the first sleeve and the first actuator from downhole portions of the section when the first sleeve is moved to the open position.

15. The method of claim 10, further comprising a closure sleeve positioned within the central flow passage axially adjacent the first sleeve, and wherein actuation of the second actuator causes the closure sleeve to translate within the central flow passage and move the first sleeve to the closed position.

16. The method of claim 10, comprising another sensor, the method further comprising:

detecting the additional wireless signal with the other sensor; and actuating the third actuator in response to the additional wireless signal and thereby moving the second sleeve to the open position.

17. A section for a downhole assembly, comprising:

a base pipe that defines a central flow passage, one or more injection ports, and one or more production ports;

a first sleeve positioned within the central flow passage adjacent the one or more injection ports;

a first sensor that detects a first wireless signal;

a first actuator communicably coupled to the first sleeve at a first location, actuatable in response to the first wireless signal to move the first sleeve toward an open position where the one or more injection ports are exposed;

a second sensor that detects a second wireless signal; and a second actuator actuatable, communicably coupled to the first sleeve at a second location, actuatable in response to the second wireless signal to move the first sleeve to a closed position where the first sleeve occludes the one or more injection ports; and a second sleeve positioned within the central flow passage adjacent the one or more production ports; and a third actuator actuatable based on one of the first wireless signal, the second wireless signal, or a third wireless signal to move the second sleeve to an open position where the one or more production ports are exposed.

18. The section of claim 17, wherein the first, second, and third wireless signals are selected from the group consisting of a magnetic field, an electromagnetic signal, a pressure signal, a temperature signal, an acoustic signal, a fluid flowrate signal, and any combination thereof.

19. The section of claim 17, wherein actuation of the third actuator is triggered following expiration of a predetermined time period after detection of the first wireless signal or the second wireless signal.

20. The section of claim 17, further comprising a third sensor that detects the third wireless signal to actuate the production actuator.

21. A method, comprising:

positioning a tubular string within a wellbore, the tubular string including at least one tubular section that includes:

a base pipe that defines a central flow passage, one or more injection ports, and one or more production ports;

a first sleeve, communicably coupled to the first sleeve at a first location, positioned within the central flow passage adjacent the one or more injection ports, a first sensor, a first actuator, a second sensor, and a second actuator, communicably coupled to the first sleeve at a second location; and a second sleeve positioned within the central flow passage adjacent the one or more production ports, and a third actuator;

detecting a first wireless signal with the first sensor and actuating the first actuator in response to the first wireless signal to move the first sleeve toward an open position where the one or more injection ports are exposed;

detecting a second wireless signal with the second sensor and actuating the second actuator in response to the second wireless signal to move the first sleeve to a closed position where first sleeve occludes the one or more injection ports; and actuating the third actuator based on one of the first wireless signal, the second wireless signal, or in response to detection of a third wireless signal to move the second sleeve to an open position where the one or more production ports are exposed.

22. The method of claim 21, wherein the first, second, and third wireless signals are selected from the group consisting of a magnetic field, an electromagnetic signal, a pressure signal, a temperature signal, an acoustic signal, a fluid flowrate signal, and any combination thereof.

23. The method of claim 21, wherein actuating the third actuator comprises triggering actuation of the third actuator upon an expiration of a predetermined time period after detection of the first wireless signal or the second wireless signal.

24. The method of claim 21, further comprising a third sensor, the method further comprising:

detecting the third wireless signal with the third sensor; and actuating the third actuator in response to the third wireless signal and thereby moving the second sleeve to the open position.

* * * * *